United States Patent [19]

Bacon et al.

[11] Patent Number: 4,705,051

[45] Date of Patent: Nov. 10, 1987

[54] POWDERED COSMETIC CONTAINER

[76] Inventors: Rosemarie Bacon; Kenneth Bacon, both of 2162 Hollywood Dr., Forked River, N.J. 08731

[21] Appl. No.: 894,652

[22] Filed: Aug. 8, 1986

[51] Int. Cl.[4] ..... A45D 40/00

[52] U.S. Cl. ..... 132/79 A

[58] Field of Search ..... 132/79 A, 79 C, 82 A, 132/82 B, 82 C, 82 D, 82 E, 82 F, 82 G, 82 R, 83 B, 83 C, 83 D; 401/44–47, 268, 270, 273; 222/142.1, 145, 158, 159; 239/304

[56] References Cited

U.S. PATENT DOCUMENTS

| | | | |
|---|---|---|---|
| 1,248,345 | 11/1917 | Kukler | 222/142.1 |
| 2,395,613 | 2/1946 | Crowell | 222/142.1 |
| 2,876,935 | 3/1959 | Lindberg | 222/145 |
| 3,856,419 | 12/1974 | Levine | 401/45 |
| 3,863,288 | 2/1975 | Aversa | 401/273 |
| 4,446,879 | 5/1984 | Gueret | 132/82 R |
| 4,471,888 | 9/1984 | Herb et al. | 222/145 |

FOREIGN PATENT DOCUMENTS

| | | | |
|---|---|---|---|
| 990028 | 9/1951 | France | 401/44 |
| 620472 | 3/1949 | United Kingdom | 401/273 |

*Primary Examiner*—John J. Wilson
*Assistant Examiner*—Michael Lynch
*Attorney, Agent, or Firm*—Stanger, Michaelson, Reynolds, Spivak & Tobia

[57] ABSTRACT

Apparatus is described for a cosmetic container that can be used for holding at least two differently colored cosmetic powders—such as colored blush, for mixing a pre-determined portion of each powder together within the container in order to yield a resulting cosmetic powder of a desired shade and for applying the resulting powder to a user's body.

11 Claims, 4 Drawing Figures

POWDERED COSMETIC CONTAINER

BACKGROUND OF THE INVENTION

1. Field of the Invention

The invention relates to apparatus for a cosmetic container which can be used for holding at least two differently colored cosmetic powders, such as colored blush, for mixing a pre-determined portion of each powder together within the container in order to yield a resulting cosmetic powder of a desired shade and for applying the resulting powder to a user's face.

2. Description of the Prior Art.

Frequently, a woman will apply various cosmetics to her face in order to achieve a certain facial appearance. One of the most commonly used cosmetic is facial blush which a woman applies to her cheeks in order to appropriately lighten or darken the appearance of both cheeks, as desired.

Facial blush is most commonly available in containers commonly referred to as "compacts". Such a container includes a small mirror, a blush applicator—generally a small brush, and a pre-determined quantity of powdered blush that has been pressed or compacted into a recess situated at the bottom of the container. Although blush sold in compacts is available in a variety of different colors, any one manufacturer produces only a finite number of different colors and shades. Therefore, if a woman desires a specific shade, she is often required to choose amongst several cosmetic manufacturers until she finds the manufacturer that produces a compact that contains blush of the specific color and shade she desires. Although a woman will only consider a small number of different colors which are usually made by all manufacturers, an almost infinite number of different shades exists between these colors and the specific shade she wants will merely be one of them. If a woman is lucky, she will find the specific shade she wants from the offerings of at least one manufacturer. However, more often than not, no manufacturer will make the specific shade of blush she desires. Consequently, to obtain this shade, a woman will frequently buy several compacts of blush of different colors and/or shades and experiment until she is able to produce the specific shade she desires. In particular, she will apply blush from each compact to her face until the color of each of her cheeks matches the specific shade she desires. Eventually, through such experimentation, the woman will determine the appropriate amount of blush she needs to apply from each compact to each cheek in order to color that cheek to the specific shade she wants. This mixing is a time consuming and messy process which must be repeated each time she applies blush to her face. Moreover, not only it is a nuisance for a woman to carry a number of different compacts in her pocketbook, but also these compacts disadvantageously consume an inordinately large amount of space in the pocketbook.

Accordingly, the need exists for a cosmetic container that can hold a number of different colors of a powdered cosmetic -- such as powdered blush, that can permit a user to appropriately mix these colors together within the container in order to obtain a powdered cosmetic of a desired shade and thereafter that can be used to apply the resulting mixed cosmetic to the user's body.

SUMMARY OF THE INVENTION

Accordingly, an object of the invention is to provide apparatus for a cosmetic container that can hold a number of differently colored cosmetic powders, such as powdered blush of different colors, and that can permit a user to mix a portion of each of these powders together within the container to yield a resulting cosmetic powder of a desired color or shade.

Another object is to provide such a container that is relatively small and can be quickly and easily used.

Lastly, another object is to provide such a container that is not messy to use.

These and other objects are achieved in accordance with the teachings of the invention by a cosmetic container comprised of a container body having a top surface and a base, said container body also comprised of at least two separate closed holding compartments, each of which holds a corresponding cosmetic powder, and a separate mixing chamber adjacently situated to each of the holding compartments; at least two valves capable of being separately actuated by said user, each valve being located on a wall situated within the container body and separating a corresponding one of the holding compartments from the mixing chamber, wherein each valve when actuated establishes a passageway between the corresponding holding compartment and the mixing chamber to allow a portion of the cosmetic powder stored in the corresponding holding compartment to enter the mixing chamber and be mixed therein with the cosmetic powders emanating from other ones of the holding compartments to form a mixed powder; an arm located within the container body and capable of being moved by a user in a substantially vertical direction within the container body and between said base and said top surface thereof; an applicator for applying the mixed cosmetic powder to a user's body wherein the applicator is mounted to one end of the arm such that when the arm is moved to one end of its travel the applicator will substantially retract into the mixing chamber wherein the applicator can be coated with the mixed powder, and when the arm is at the other end of its travel the applicator will extend through both the mixing chamber and the top surface of the container body such that the applicator can be stroked against the user's body to transfer a portion of the mixed powder thereto.

In accordance with a feature of the present invention, a blotting sponge is mounted along the bottom of the container body. This sponge is used by simply inverting the container and then pressing the sponge appearing on the underside of the container against the cheek. As the sponge is wiped across the cheek, the sponge absorbs excess blush from the cheek and spreads the remaining blush across the cheek to provide a smooth diffused coloration on the cheek.

BRIEF DESCRIPTION OF THE DRAWING

The teachings of the present invention may be clearly understood by considering the following description in conjunction with the accompanying drawing, in which.

To facilitate understanding, identical reference numerals are used to denote identical elements common to the figures.

DETAILED DESCRIPTION

Those skilled in the art will quickly realize from reading the following detailed description that the inventive cosmetic container can be used in conjunction with any of a large variety of different colored cosmetic powders. Nonetheless, for purposes of brevity, the invention will be specifically described in the context of a container for holding, mixing and applying powdered blush.

Figure 1:
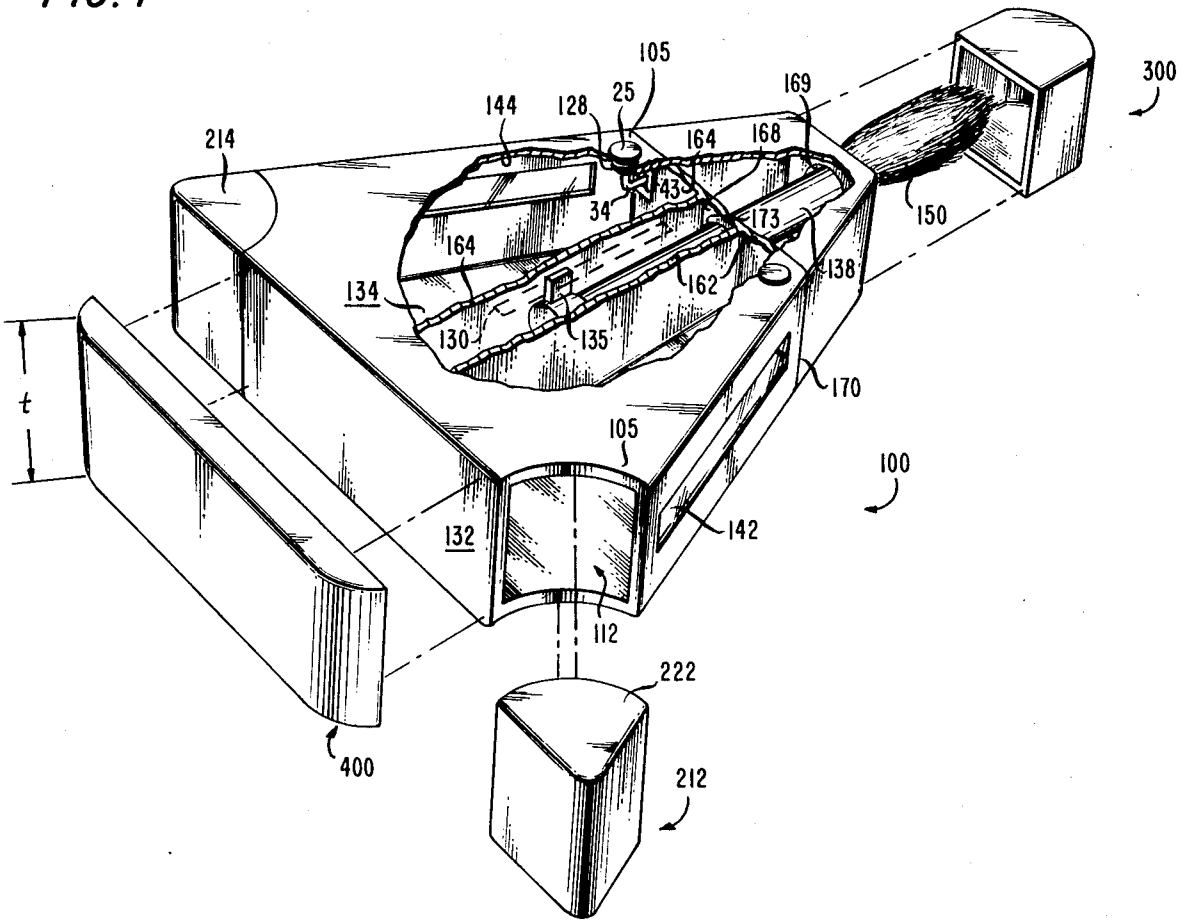
FIG. 1 is a partial cutaway rear perspective view of a cosmetic container constructed in accordance with the present invention.

A partial cutaway rear perspective view of a cosmetic container embodying the teachings of the present invention is shown in FIG. 1. As shown, the container consists of four sections: container body 100, endcaps 212 and 214, blotting sponge 400 and brush cap 300.

Container body 100 has a truncated triangular shape of rectangular cross section of generally constant thickness. The dimensions of the container body are not critical at all. In fact, the container body can be any one of many different sizes. One illustrative size which yields a cosmetic container that conserves space and is easily held and used is: two to three inches (approximately 5–7.5 cm) wide at the base of the container but tapering down to approximately ¾ inch (1.25 cm) across the truncated top surface, three inches high and a constant ½ to ¾ inches (1.25–2 cm) in thickness (dimension "t"). Brush cap 300 may itself be approximately ½ inch (approximately 1.25 cm) in height and may have the same thickness as the container body.

Container body 100 contains two separate holding compartments (holding chambers) 132 and 134 and mixing chamber 165. Holding compartments 132 and 134 are isolated from each other and from the mixing compartment (mixing chamber) by walls 162 and 164, respectively. Each holding compartment is used to hold powdered blush of a given color. Inasmuch as this embodiment has two separate holding chambers, two different colors (or shades) can be accommodated. For example, compartment 132 may contain light tan blush; while a darker blush, e.g. a taupe blush, may be held in compartment 134. Clearly, if additional holding compartments, e.g. three or more, each with an accompanying mixing valve, as discussed in detail below, are included in the container body, then the container body can hold a correspondingly greater number of different colors (and shades) of powdered blush. A removeable end cap is located at each vertex of the container body along its base in order to fill each holding compartment with powdered blush. In particular, when endcap 212 is removed, access is provided through opening 112 to holding compartment 132. Likewise, whenever endcap 214 is removed, access is similarly provided to holding compartment 134. Each endcap matingly abuts, along its rear surface, such as surface 222 for endcap 212, with a corresponding surface of the container body, and is merely held in place against that latter surface by a snap fit as is well known in the art. Appropriate well-known gasketing (not shown) may be included, if needed, around the rear surface of each endcap that mates with the container body in order to prevent powdered blush from leaking from the container body. A separate sighting port for each holding compartment is provided to allow the user to readily ascertain the level of blush in each compartment by merely holding the cosmetic container in an upright position. Here, sighting ports 142 and 144 are provided for holding compartments 132 and 134, respectively. Each sighting port is merely a transparent window that is formed in the side of the container body and extends along most of the length of the corresponding holding compartment.

Mixing valves 122 and 124 are provided for holding compartments 132 and 134, respectively, to direct a desired amount of blush from each compartment into the mixing chamber. Each holding compartment has its own valve. Inasmuch as all the valves are identical, discussion will center only on valve 124. This valve is merely a flapper valve actuated by a spring loaded pushbutton. In particular, whenever spring loaded pushbutton 25 located on external top surface 105 of container body 100 is depressed, arm 34 moves downward to cause flapper valve 43 in wall 164 t o pivot outward into mixing chamber 165 to provide an opening therethrough. Whenever pushbutton 25 is depressed, spring 28 located directly beneath button 25 and concentric with the portion of arm 34 extending immediately therebelow forces the pushbutton upward from top surface 105 to cause the flapper valve to pivotedly move against wall 164 and thereby seal the opening between holding compartment 134 and mixing compartment 165. The flapper valve could be replaced by an appropriate poppet valve instead. To move blush into the mixing chamber, the user merely depresses the appropriate pushbutton and either shakes the cosmetic container or inverts it for a very short time in order to meter an appropriate amount of colored blush powder through the valve.

Figure 2:
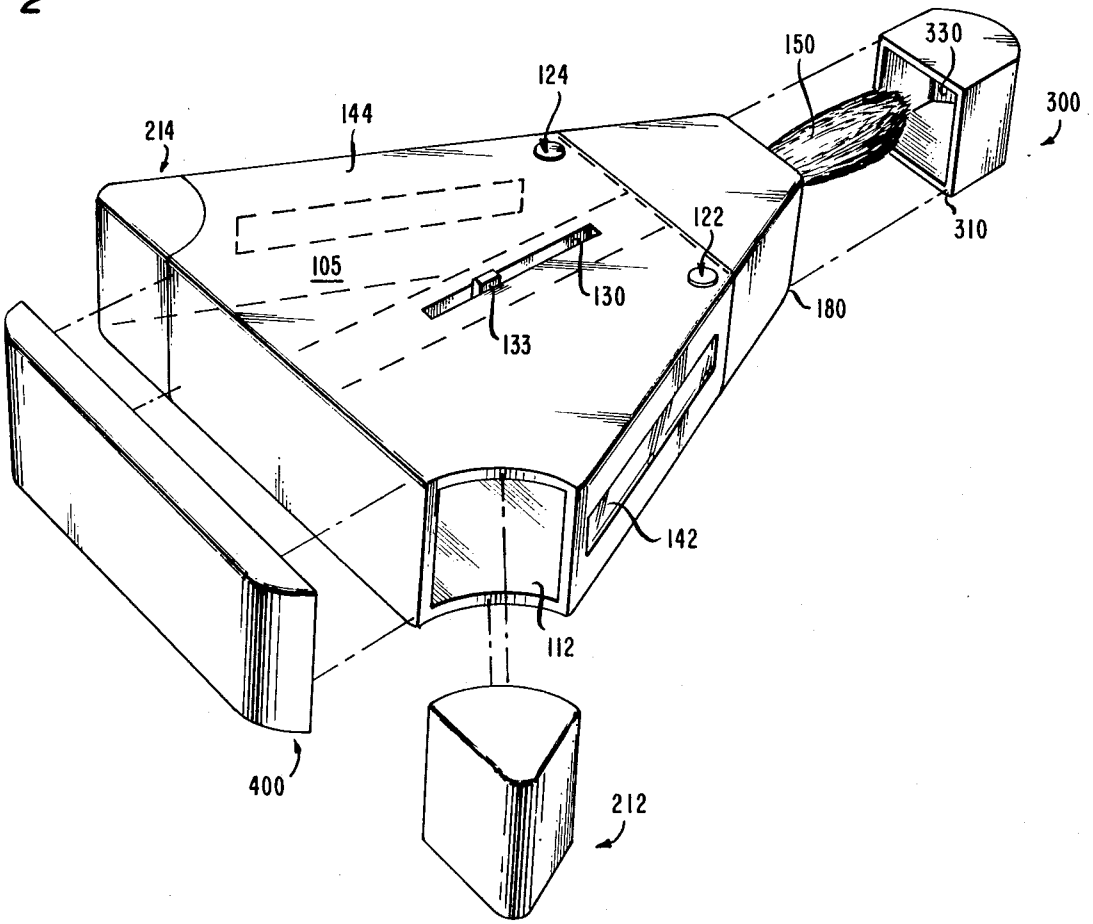
FIG. 2 is a rear perspective view of the cosmetic container shown in FIG. 1.
Figure 3:
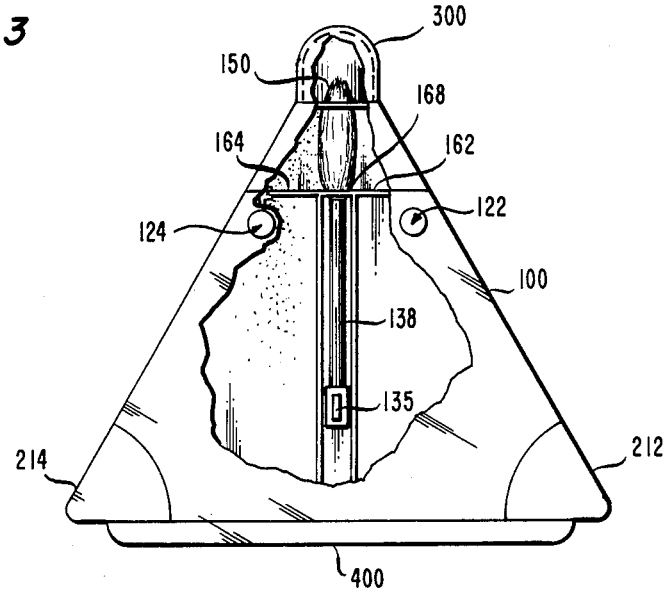
FIG. 3 is a partial cutaway side view of the cosmetic container shown in FIG. 1 with brush 150 shown in its fully retracted position.
Figure 4:
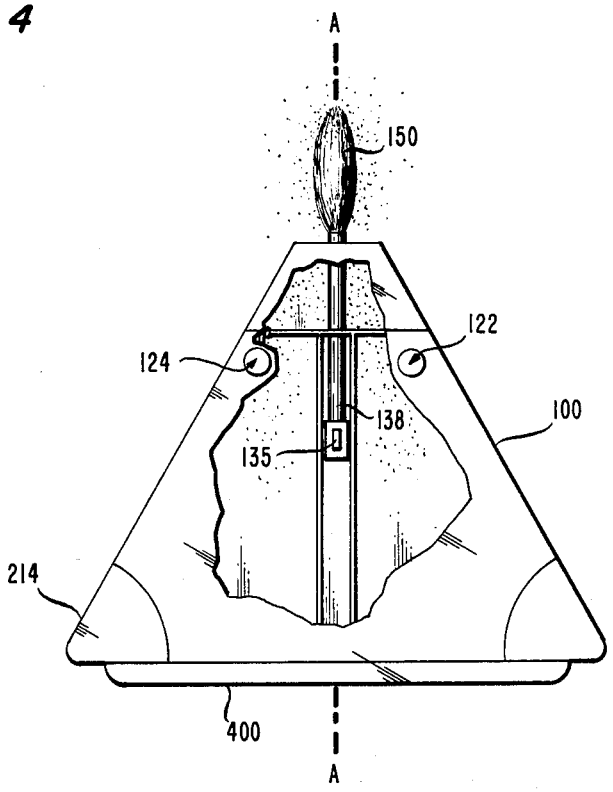
FIG. 4 is also a partial cutaway side view of the cosmetic container shown in FIG. 1 but here with brush 150 shown in its fully extended position.

To permit the user to easily apply blush to her body, container body 100 also includes retractable brush 150. This brush is mounted to one end of shaft (arm) 138 and protrudes through wall 168 and through opening 169 in the top truncated surface of container body 100. A collar is mounted to the other end of shaft 138. To constrain the movement of the brush, guide pin 133 protrudes upward from the collar and is constrained to move within slot 130 (shown in dotted lines in the cutaway view in FIG. 1 and in solid lines in the rear perspective view in FIG. 2). To allow the user to easily retract and extend the brush, one end of the guide pin protrudes through surface 105. When the user moves the guide pin to the bottom of slot 130, the brush is fully retracted as shown in FIG. 3. Alternatively, whenever the user moves the guide pin to the top of the slot, the brush is fully extended as shown in FIG. 4. As shown in FIGS. 1, 3 and 4, shaft 138 travels along the central vertical axis of the container body (axis A—A specifically shown in FIG. 4) in a space located between walls 162 and 164. These walls also serve to minimize any lateral movement of the shaft. To prevent blush from leaking through the mixing chamber along the openings provided therein for shaft 138, appropriate well-known gaskets (not shown), such as O-rings, are each installed, as shown in FIG. 1, in opening 169 located in the top surface of the mixing chamber and in opening 173 located in wall 168. Other well-known seals may also be used in lieu of O-rings.

Whenever the brush is not being used, it is preferably fully retracted into the container body, as shown in FIG. 3. The user can then cover the brush with brush cap 300 and thereby prevent it from contacting and soiling any surrounding articles. This cap matingly abuts against the truncated top surface of container body 100 and, like endcaps 212 and 214, is held in place against the container body by an appropriate snap fit.

To use the inventive cosmetic container, a user first meters the appropriate amount of blush from each holding compartment into the mixing chamber through the mixing valves, as discussed above, with the brush fully retracted into the container body and the brush cap in place. Thereafter, the user releases both mixing valves and shakes the cosmetic container a few times to thoroughly mix the blush in the mixing chamber and force the mixed blush to contact the sides of the retracted brush. Thereafter, the user removes the brush cap and extends the brush. The sides of the brush will be coated with the mixed blush. Then user can then transfer the mixed blush to her cheek by merely stroking the brush against her cheek.

Oftentimes, a user might inadvertently apply an excessive amount of blush to her cheek. Blotting sponge 400 is advantageously mounted along the bottom surface of container body 100 to permit the user to easily remove any excessive blush and also smooth the coloration of the remaining blush on her cheek. This sponge is used by simply inverting the cosmetic container and then pressing the sponge appearing on the underside of the cosmetic container against the cheek. As the sponge is wiped across the cheek, the sponge absorbs excess blush from the cheek and spreads the remaining blush across the cheek to provide a smooth diffused coloration thereon.

From time to time, a user may desire to clean the mixing chamber in order to remove any residual blush that has accumulated therein. To provide this capability, the mixing chamber is advantageously a single assembly that matingly abuts against the rest of container body 100 along junction 170 and is held in place by a snap fit. Appropriate gasketing (well-known and not shown) exists along this junction between the mixing chamber and the remainder of the container body to prevent any blush from leaking therethrough. In this manner, the mixing chamber can be easily removed from remainder of the container body, thoroughly cleaned and then appropriately "snapped" into position on the container body for the next use.

Although, the inventive cosmetic container is shown as being triangular, this shape is merely chosen to provide a thin overall cross-section which conserves space and is yet easy to hold and use. Clearly, many other shapes may be used. For example, in lieu of a rectangular cross-section, the container body may have a triangular, circular, or hexagonal cross-section. In addition, the container body may have more than two, e.g. four, separate holding compartments. The only requirement is that each holding compartment should possess its own mixing valve and sighting port. As such, the geometry of the container body will to some extent be governed by the number of separate holding compartments. Moreover, since style considerations often influence the shape of cosmetic containers, these considerations can also influence the shape of the inventive cosmetic container as well as the functional considerations noted above.

Although a single preferred embodiment has been shown and described herein, many varied arrangements incorporating the principles of the present invention can be constructed by those skilled in the art.

We claim:

1. Apparatus for a cosmetic container useful for separately holding at least two cosmetic powders, for mixing a desired portion of each of said powders to form a mixed powder and for applying the mixed powder to a user's body, said apparatus comprising:

a container body having a top surface and a base, said container body also comprised of at least two separate closed holding compartments, each of which holds a corresponding one of said cosmetic powders, and a separate mixing chamber adjacently situated to each of said holding compartments;

at least two valves capable of being separately actuated by said user, each valve being located on a wall situated within said container body and separating a corresponding one of said holding compartments from said mixing chamber, wherein each valve when actuated establishes a passageway between the corresponding holding compartment and said mixing chamber to allow a portion of the cosmetic powder stored in the corresponding holding compartment to enter said mixing chamber and be mixed therein with the cosmetic powders emanating from other ones of said holding compartments to form said mixed powder;

an arm located within said container body and capable of being moved by said user in a substantially vertical direction within said container body and between said base and said top surface;

an applicator for applying said mixed cosmetic powder to a user's body wherein said applicator is mounted to one end of said arm such that when said arm is moved to one end of its travel the applicator will substantially retract into said mixing chamber wherein the applicator can be coated with said mixed powder, and when said arm is at the other end of its travel said applicator will extend through both said mixing chamber and said top surface of said container body such that the applicator can be stroked against the user's body to transfer a portion of said mixed powder thereto.

2. The apparatus in claim 1 wherein said arm is constrained to travel along a central vertical axis of said container body.

3. The apparatus in claim 2 wherein said container body further comprises a plurality of substantially transparent sighting ports formed in corresponding sides of the container body, wherein each sighting port is used for ascertaining the level of the cosmetic powder contained in a corresponding one of said holding compartments.

4. The apparatus in claim 3 wherein said container body further comprises a blotting sponge affixed to the base.

5. The apparatus in claim 4 wherein said container body further comprises a cap matingly engaged to each holding compartment and removeable therefrom for providing access to said holding compartment in order to fill said compartment with a corresponding one of said cosmetic powders.

6. The apparatus in claim 5 wherein said container body has the shape of a truncated triangle with a substantially rectangular cross-section and a substantially constant thickness.

7. The apparatus in claim 6 wherein said holding compartments are situated on opposite sides of said arm.

8. The apparatus in claim 7 wherein each of said valves is a flapper valve and is actuated by a respective arm that extends from said valve to an external surface of said container body.

9. The apparatus in claim 8 wherein said applicator is a brush.

10. The apparatus in claim 9 further comprised of a cap that matingly abuts against the top surface of said container body for covering substantially all portions of the brush that protrude through said top surface whenever said brush is fully retracted into said container body.

11. The apparatus in claim 10 wherein said mixing chamber is situated above each of said holding compartments and matingly abuts against the remainder of said container body such that access can be obtained to the mixing chamber by disengaging the mixing chamber from the container body.

* * * * *